US007822599B2

(12) United States Patent
Gigi

(10) Patent No.: US 7,822,599 B2
(45) Date of Patent: Oct. 26, 2010

(54) METHOD FOR SYNTHESIZING SPEECH

(75) Inventor: Ercan Ferit Gigi, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1417 days.

(21) Appl. No.: 10/511,369

(22) PCT Filed: Apr. 1, 2003

(86) PCT No.: PCT/IB03/01249

§ 371 (c)(1),
(2), (4) Date: Oct. 14, 2004

(87) PCT Pub. No.: WO03/090205

PCT Pub. Date: Oct. 30, 2003

(65) Prior Publication Data

US 2005/0131679 A1 Jun. 16, 2005

(30) Foreign Application Priority Data

Apr. 19, 2002 (EP) ..... 02076542

(51) Int. Cl.
*G10L 11/00* (2006.01)

(52) U.S. Cl. ..... 704/205; 704/207

(58) Field of Classification Search ..... 704/205–207
See application file for complete search history.

(56) References Cited

U.S. PATENT DOCUMENTS 5,081,681 A 1/1992 Hardwick
5,189,701 A * 2/1993 Jain ..... 704/207
5,787,398 A 7/1998 Lowry
6,067,511 A * 5/2000 Grabb et al. ..... 704/223
6,292,777 B1 * 9/2001 Inoue et al. ..... 704/230
6,453,283 B1 9/2002 Gigi
6,571,207 B1 5/2003 Kim

FOREIGN PATENT DOCUMENTS

EP 0995190 B1 8/2005
GB 2352598 A 1/2001
WO WO 9959139 * 11/1999

OTHER PUBLICATIONS

Klabbers, E. et al "Reducing Audible Spectral Discontinuities" IEEE Transactions on Speech and Audio Processing, vol. 9. No. 1, Jan. 2001. pp. 39-51.

Stylianou, Y. "Removing Linear Phase Mismatches in Concatenative Speech Synthesis" IEEE Transactions on Speech and Audio Processing, vol. 9. No. 3, Mar. 2001. pp. 232-239.

Moulines, Eric et al "Pitch-Synchronous Waveform Processing Techniques for Text-to-Speech Synthesis using Diphones" Speech Communication, vol. 9, pp. 453-467, 1990.

(Continued)

*Primary Examiner*—Angela A Armstrong

(57) ABSTRACT

The present invention relates to a method for analyzing speech, the method comprising the steps of: a) inputting a speech signal, b) obtaining the first harmonic of the speech signal, c) determining the phase-difference Df between the speech signal and the first harmonic.

24 Claims, 7 Drawing Sheets

OTHER PUBLICATIONS

Violaro, Fabio et al "A Hybrid Model for Text-to-Speech Synthesis" IEEE Transactions on Speech and Audio Processing, vol. 6, No. 5, Sep. 1998.

Meyer, P. et al "Phritts—A Text to Speech Synthesizer for the German Language" In Eurospeech '93, pp. 877-890, (1993).

Dutoit, T. et al1 "MBR-PSOLA: Text-to-Speech Synthesis based on an MBE re-Synthesis of the Segments Database" Speech Communication, vol. 13, 1993, pp. 435-440.

* cited by examiner

| 701 | 702 | 703 | |
|---|---|---|---|
| _ | 100 | | |
| h | 55 | ( 0, 111) | |
| @ | 63 | ( 20, 133) | |
| l | 64 | | |
| @U | 128 | ( 20, 139) | |
| w | 53 | | |
| =r | 233 | ( 20, 133) | ( 80, 100) |
| l | 87 | | |
| d | 66 | | |
| _ | 300 | (100, 83) | |

FIG.7

| | |
|---|---|
| _,h | *(silence to 'h')* |
| h,@ | *('h' to the schwa '@')* |
| @,l | *etc.* |
| l,@U | |
| @U,w | |
| w,=r | |
| =r,l | |
| l,d | |
| d,_ | |

FIG.8

METHOD FOR SYNTHESIZING SPEECH

FIELD OF THE INVENTION

The present invention relates to the field of analyzing and synthesizing of speech and more particularly without limitation, to the field of text-to-speech synthesis.

BACKGROUND AND PRIOR ART

The function of a text-to-speech (TTS) synthesis system is to synthesize speech from a generic text in a given language. Nowadays, TTS systems have been put into practical operation for many applications, such as access to databases through the telephone network or aid to handicapped people. One method to synthesize speech is by concatenating elements of a recorded set of subunits of speech such as demisyllables or polyphones. The majority of successful commercial systems employ the concatenation of polyphones. The polyphones comprise groups of two (diphones), three (triphones) or more phones and may be determined from nonsense words, by segmenting the desired grouping of phones at stable spectral regions. In a concatenation based synthesis, the conversation of the transition between two adjacent phones is crucial to assure the quality of the synthesized speech. With the choice of polyphones as the basic subunits, the transition between two adjacent phones is preserved in the recorded subunits, and the concatenation is carried out between similar phones.

Before the synthesis, however, the phones must have their duration and pitch modified in order to fulfill the prosodic constraints of the new words containing those phones. This processing is necessary to avoid the production of a monotonous sounding synthesized speech. In a TTS system, this function is performed by a prosodic module. To allow the duration and pitch modifications in the recorded subunits, many concatenation based TTS systems employ the time-domain pitch-synchronous overlap-add (TD-PSOLA) (E. Moulines and F. Charpentier, "Pitch synchronous waveform processing techniques for text-to-speech synthesis using diphones," Speech Commun., vol. 9, pp. 453467, 1990) model of synthesis.

In the TD-PSOLA model, the speech signal is first submitted to a pitch marking algorithm. This algorithm assigns marks at the peaks of the signal in the voiced segments and assigns marks 10 ms apart in the unvoiced segments. The synthesis is made by a superposition of Hanning windowed segments centered at the pitch marks and extending from the previous pitch mark to the next one. The duration modification is provided by deleting or replicating some of the windowed segments. The pitch period modification, on the other hand, if provided by increasing or decreasing the superposition between windowed segments.

Despite the success achieved in many commercial TTS systems, the synthetic speech produced by using the TD-PSOLA model of synthesis can present some drawbacks, mainly under large prosodic variations, outlined as follows.

1. The pitch modifications introduce a duration modification that needs to be appropriately compensated.
2. The duration modification can only be implemented in a quantized manner, with a one pitch period resolution ($\alpha$= . . . ,1/2,2/3,3/4, . . . ,4/3,3/2,2/1, . . . ).
3. When performing a duration enlargement in unvoiced portions, the repetition of the segments can introduce "metallic" artifacts (metallic-like sounding of the synthesized speech).

In IEEE transactions on speech and audio processing, vol. 6, No. 5, September 1998, "A Hybrid Model for Text-to-Speech Synthesis", Fábio Violaro and Olivier Böeffard, a hybrid model for concatenation-based, text-to-speech synthesis is described.

The speech signal is submitted to a pitch-synchronous analysis and decomposed into a harmonic component, with a variable maximum frequency, plus a noise component. The harmonic component is modeled as a sum of sinusoids with frequencies multiple of the pitch. The noise component is modeled as a random excitation applied to an LPC filter. In unvoiced segments, the harmonic component is made equal to zero. In the presence of pitch modifications, a new set of harmonic parameters is evaluated by resampling the spectrum envelope at the new harmonic frequencies. For the synthesis of the harmonic component in the presence of duration and/or pitch modifications, a phase correction is introduced into the harmonic parameters.

A variety of other so called "overlap and add" methods are known from the prior art, such as PIOLA (Pitch Inflected OverLap and Add) [P. Meyer, H. W. Rüh, R. Krüger, M. Kugler L. L. M. Vogten, A. Dirksen, and K. Belhoula. PHRITTS: A text-to-speech synthesizer for the German language. In Eurospeech '93, pages 877-890, Berlin, 1993], or PICOLA (Pointer Interval Controlled OverLap and Add) [Morita: "A study on speech expansion and contraction on time axis", Master thesis, Nagoya University (1987), in Japanese.] These methods differ from each other in the way they mark the pitch period locations.

None of these methods give satisfactory results when applied as a mixer for two different waveforms. The problem is phase mismatches. The phases of harmonics are affected by the recording equipment, room acoustics, distance to the microphone, vowel color, co-articulation effects etc. Some of these factors can be kept unchanged like the recording environment but others like the co-articulation effects are very difficult (if not, impossible) to control. The result is that when pitch period locations are marked without taken into account the phase information, the synthesis quality will suffer from phase mismatches.

Other methods like MBR-PSOLA (Multi Band Resynthesis Pitch Synchronous OverLap Add) [T. Dutoit and H. Leich. MBR-PSOLA: Text-to-speech synthesis based on an MBE re-synthesis of the segments database. Speech Communication, 1993] regenerate the phase information to avoid phase mismatches. But this involves an extra analysis-synthesis operation that reduces the naturalness of the generated speech. The synthesis often sounds mechanic.

U.S. Pat. No. 5,787,398 shows an apparatus for synthesizing speech by varying pitch. One of the disadvantages of this approach is that since the pitch marks are centered on the excitation peaks and the measured excitation peak does not necessarily have synchronous phase, phase distortion results.

The pitch of synthesized speech signals is varied by separating the speech signals into a spectral component and an excitation component. The latter is multiplied by a series of overlapping window functions synchronous, in the case of voiced speech, with pitch timing mark information corresponding at least approximately to instants of vocal excitation, to separate it into windowed speech segments which are added together again after the application of a controllable time-shift. The spectral and excitation components are then recombined. The multiplication employs at least two windows per pitch period, each having a duration of less than one pitch period.

U.S. Pat. No. 5,081,681 shows a class of methods and related technology for determining the phase of each harmonic from the fundamental frequency of voiced speech.

Applications include speech coding, speech enhancement, and time scale modification of speech. The basic approach is to include recreating phase signals from fundamental frequency and voiced/unvoiced information, and adding a random component to the recreated phase signal to improve the quality of the synthesized speech.

U.S. Pat. No. 5,081,681 describes a method for phase synthesis for speech processing. Since the phase is synthetic the result of the synthesis does not sound natural as many aspects of the human voice and the acoustics of the surround are ignored by the synthesis.

SUMMARY OF THE INVENTION

The present invention provides for a method for analyzing of speech, in particular natural speech. The method for analyzing of speech in accordance with the invention is based on the discovery, that the phase difference between the speech signal, in particular a diphone speech signal, and the first harmonic of the speech signal is a speaker dependent parameter which is basically a constant for different diphones.

In accordance with a preferred embodiment of the invention this phase difference is obtained by determining a maximum of the speech signal and by determining the phase zero, i. e. the positive zero crossing of the first harmonic. The difference between the phases of the maximum and phase zero is the speaker dependent phase difference parameter.

In one application this parameter serves as a basis to determine a window function, such as a raised cosine or a triangular window. Preferably the window function is centered on the phase angle which is given by the zero phase of the first harmonic plus the phase difference. Preferably the window function has its maximum at that phase angle. For example, the window function is chosen to be symmetric with respect to that phase angle.

For speech synthesis diphone samples are windowed by means of the window function, whereby the window function and the diphone sample to be windowed are offset by the phase difference.

The diphone samples which are windowed this way are concatenated. This way the natural phase information is preserved such that the result of the speech synthesis sounds quasi natural.

In accordance with a preferred embodiment of the invention control information is provided which indicates diphones and a pitch contour. For example such control information can be provided by the language processing module of a text-to-speech system.

It is a particular advantage of the present invention in comparison to other time domain overlap and add methods that the pitch period (or the pitch-pulse) locations are synchronized by the phase of the first harmonic.

The phase information can be retrieved by low-pass filtering the first harmonic of the original speech signal and using the positive zero-crossing as indicators of zero-phase. This way, the phase discontinuity artifacts are avoided without changing the original phase information.

Applications for the speech synthesis methods and the speech synthesis device of the invention include: telecommunication services, language education, aid to handicapped persons, talking books and toys, vocal monitoring, multimedia, man-machine communication.

BRIEF DESCRIPTION OF THE DRAWINGS

In the following preferred embodiments of the invention are described in greater detail by making reference to the drawings in which:

FIG. 7 is an example of a file containing phonetic information, FIG. 8 is an example of a file containing diphone information extracted from the file of FIG. 7.

DETAILED DESCRIPTION

Figure 1:
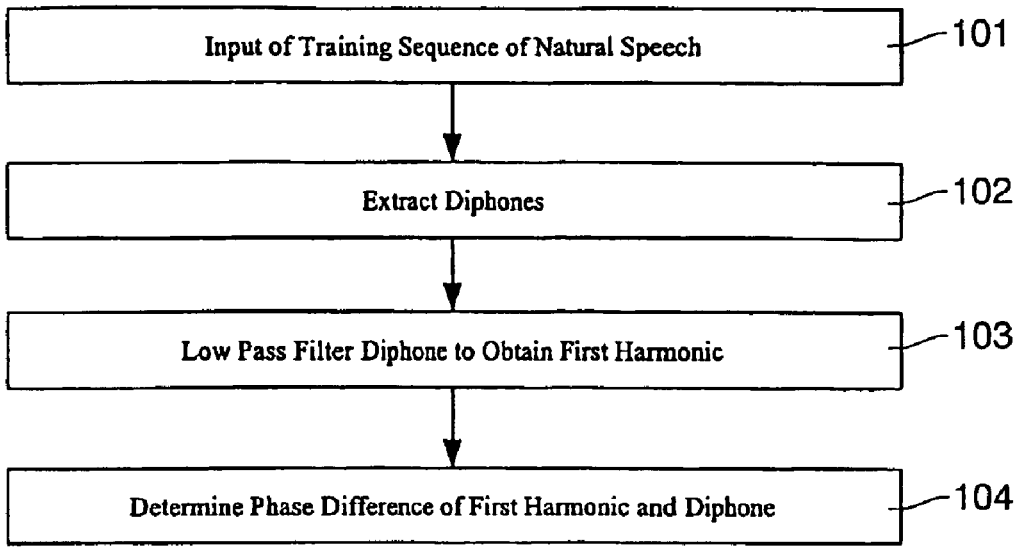
FIG. 1 is illustrative of a flow chart of a method to determine the phase difference between a diphone at its first harmonic.

The flow chart of FIG. 1 is illustrative of a method for speech analysis in accordance with the present invention. In step 101 natural speech is inputted. For the input of natural speech known training sequences of nonsense words can be utilized. In step 102 diphones are extracted from the natural speech. The diphones are cut from the natural speech and consist of the transition from one phoneme to the other.

In the next step 103 at least one of the diphones is low-pass filtered to obtain the first harmonic of the diphone. This first harmonic is a speaker dependent characteristic which can be kept constant during the recordings.

In step 104 the phase difference between the first harmonic and the diphone is determined. Again this phase difference is a speaker specific voice parameter. This parameter is useful for speech synthesis as will be explained in more detail with respect to FIGS. 3 to 10.

Figure 2:
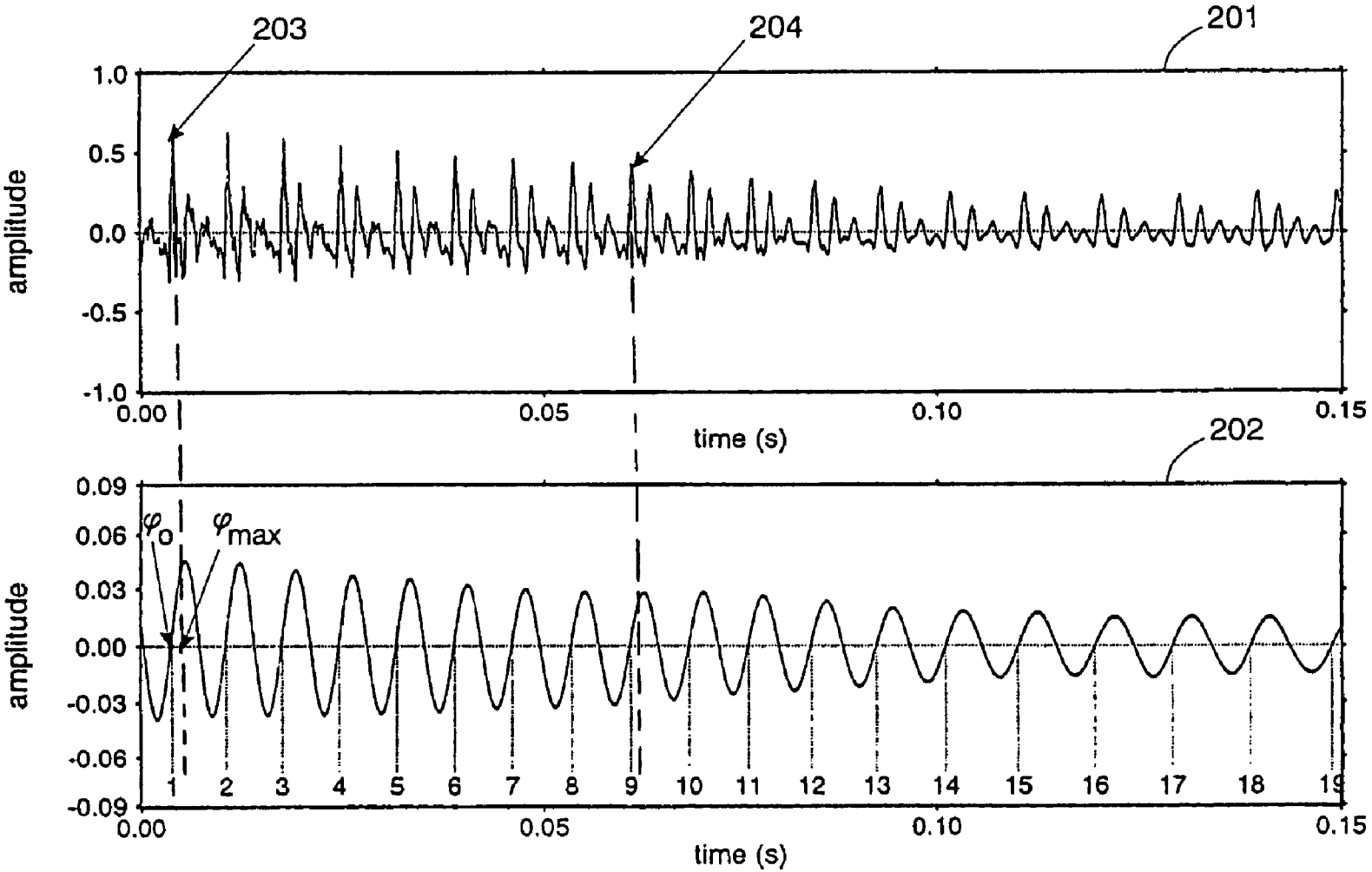
FIG. 2 is illustrative of signal diagrams to illustrate an example of the application of the method of FIG. 1.

FIG. 2 is illustrative of one method to determine the phase difference between the first harmonic and the diphone (cf. step 4 of FIG. 1). A sound wave 201 acquired from natural speech forms the basis for the analysis. The sound wave 201 is low-pass filtered with a cut-off frequency of about 150 Hz in order to obtain the first harmonic 202 of the sound wave 201. The positive zero-crossings of the first harmonic 202 define the phase angle zero. The first harmonic 202 as depicted in FIG. 2 covers a number of 19 succeeding complete periods. In the example considered here the duration of the periods slightly increases from period 1 to period 19. For one of the periods the local maximum of the sound waveform 201 within that period is determined.

For example the local maximum of the sound wave 201 within the period 1 is the maximum 203. The phase of the maximum 203 within the period 1 is denoted as $\phi_{max}$ in FIG. 2. The difference $\Delta\phi$ between $\phi_{max}$ and the zero phase $\phi_0$ of the period 1 is a speaker dependent speech parameter. In the example considered here this phase difference is about 0.3 $\pi$. It is to be noted that this phase difference is about constant irrespective of which one of the maxima is utilized in order to determine this phase difference. It is however preferable to choose a period with a distinctive maximum energy location for this measurement. For example if the maximum 204 within the period 9 is utilized to perform this analysis the resulting phase difference is about the same as for the period 1.

Figure 3:
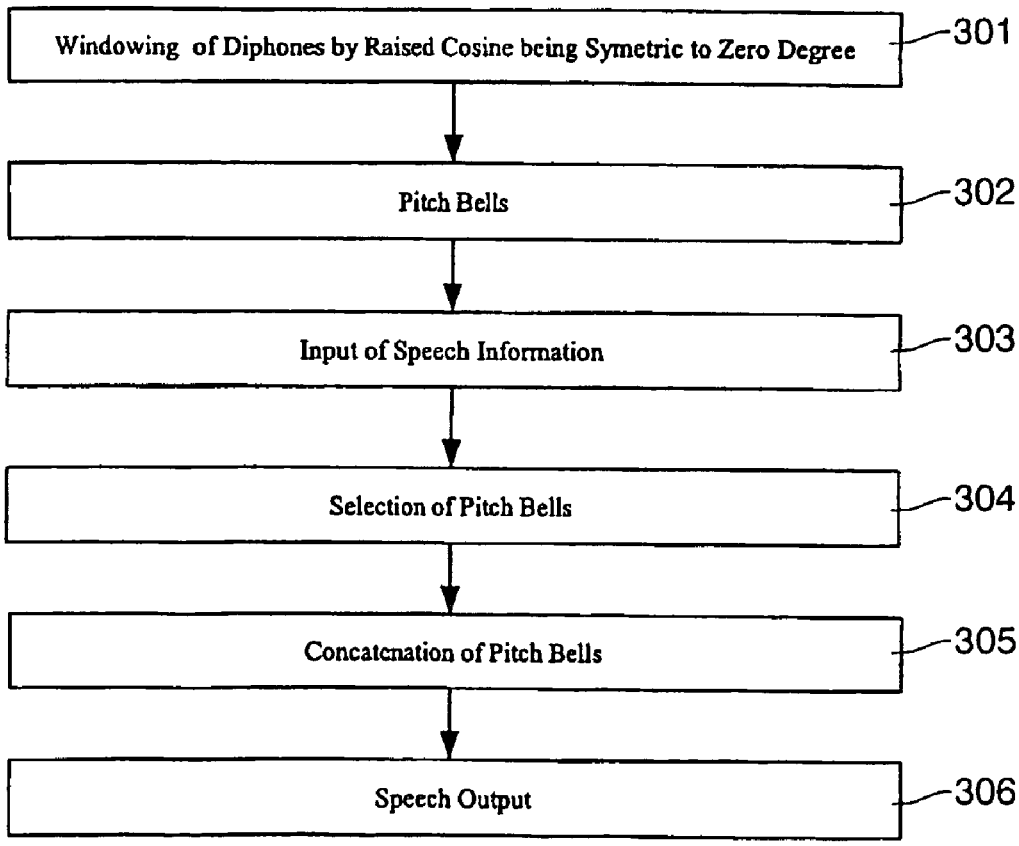
FIG. 3 is illustrative of an embodiment of the method of the invention for synthesizing speech.

FIG. 3 is illustrative of an application of the speech synthesis method of the invention. In step 301 diphones which have been obtained from natural speech are windowed by a window function which has its maximum at $\phi_0+\Delta\phi$; for example a raised cosine which is centered with respect to the phase $\phi_0+\Delta\phi$ can be chosen.

This way pitch bells of the diphones are provided in step 302. In step 303 speech information is inputted. This can be information which has been obtained from natural speech or from a text-to-speech system, such as the language processing module of such a text-to-speech system.

In accordance with the speech information pitch bells are selected. For instance the speech information contains information of the diphones and of the pitch contour to be synthesized. In this case the pitch bells are selected accordingly in step 304 such that the concatenation of the pitch bells in step 305 results in the desired speech output in step 306.

Figure 4:
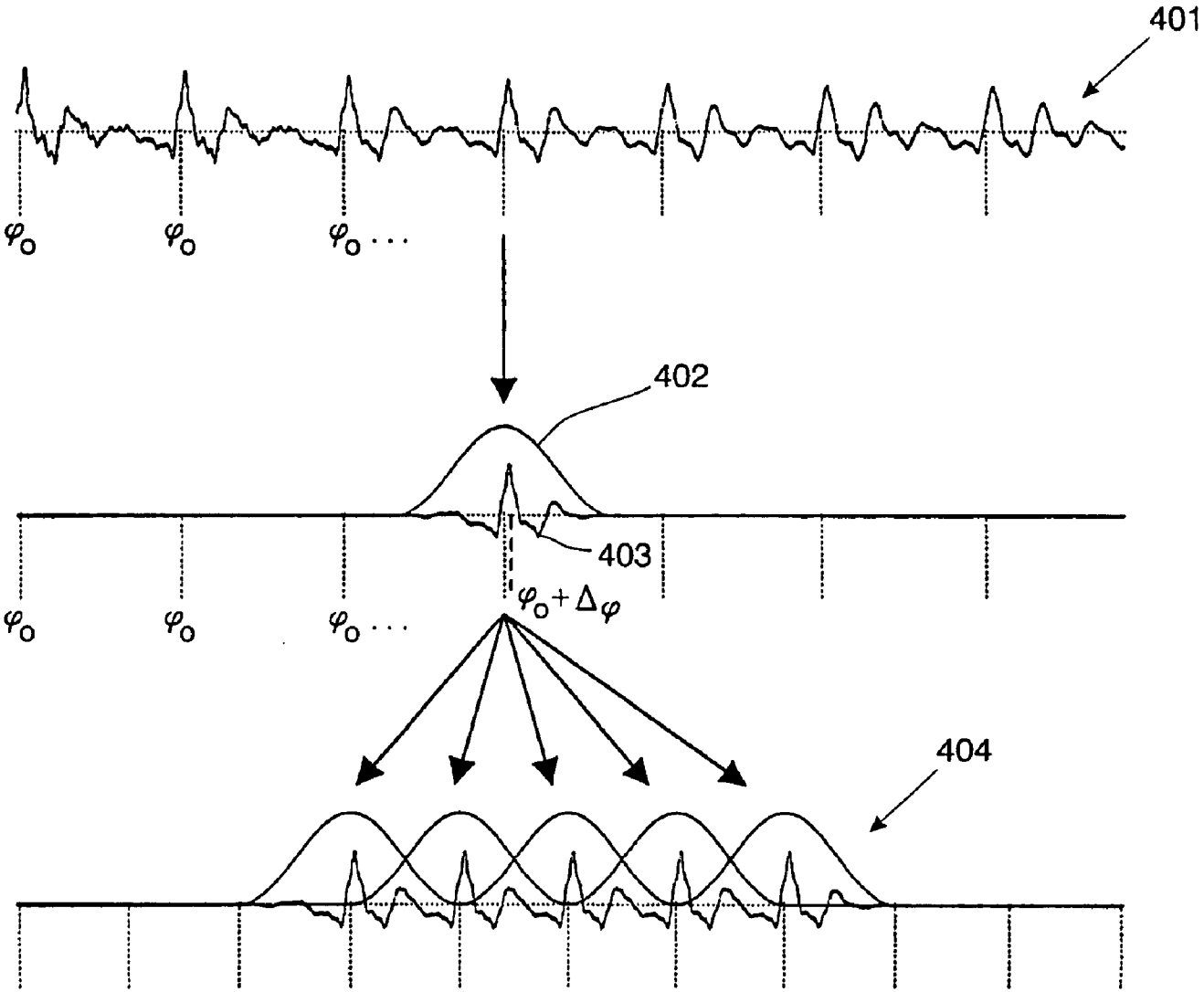
FIG. 4 shows an application example of the method of FIG. 3.

An application of the method of FIG. 3 is illustrated by way of example in FIG. 4. FIG. 4 shows a sound wave 401 which consists of a number of diphones. The analysis as explained with respect to FIGS. 1 and 2 above is applied to the sound wave 401 in order to obtain the zero phase $\phi_0$ for each of the pitch intervals. As in the example of FIG. 2 the zero phase $\phi_0$ is offset from the phase $\phi_{max}$ of the maximum within the pitch interval by a phase angle of $\Delta\phi$ which is about constant.

A raised cosine 402 is used to window the sound wave 401. The raised cosine 402 is centered with respect to the phase $\phi_0+\Delta\phi$. Windowing of the sound wave 401 by means of the raised cosine 402 provides successive pitch bells 403. This way the diphone waveforms of the sound wave 401 are split into such successive pitch bells 403. The pitch bells 403 are obtained from two neighboring periods by means of the raised cosine which is centered to the phase $\phi_0+\Delta\phi$. An advantage of utilizing a raised cosine rather than a rectangular function is that the edges are smooth this way. It is to be noted that this operation is reversible by overlapping and adding all of the pitch bells 403 in the same order; this produces about the original sound wave 401.

The duration of the sound wave 401 can be changed by repeating or skipping pitch bells 403 and/or by moving the pitch bells 403 towards or from each other in order to change the pitch. The sound wave 404 is synthesized this way by repeating the same pitch bell 403 with a higher than the original pitch in order to increase the original pitch of the sound wave 401. It is to be noted that the phases remain in tact as a result of this overlapping operation because of the prior window operation which has been performed taking into account the characteristic phase difference $\Delta\phi$. This way pitch bells 403 can be utilized as building blocks in order to synthesize quasi-natural speech.

Figure 5:
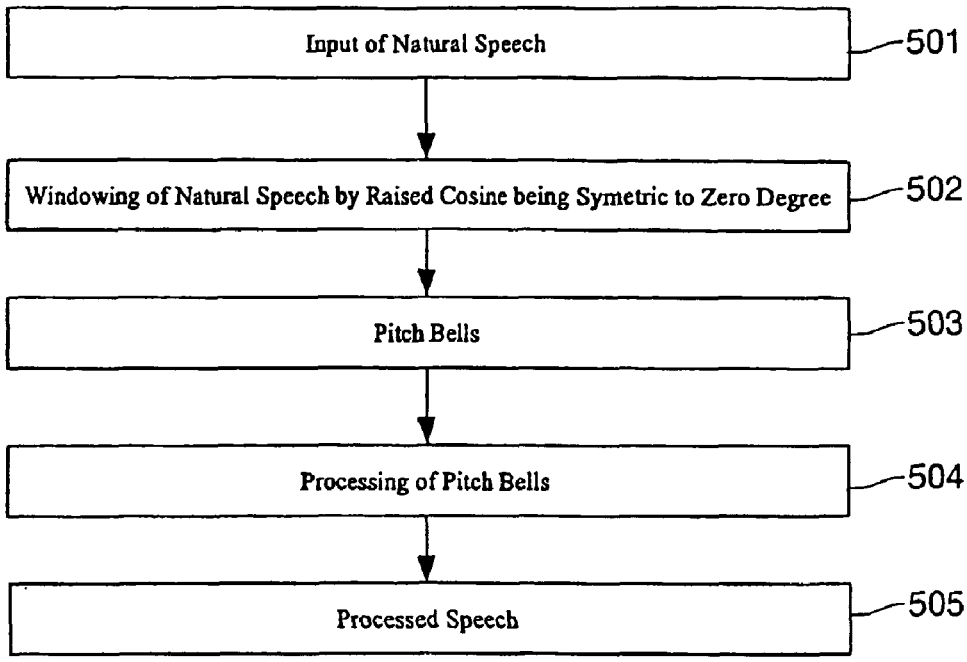
FIG. 5 is illustrative of an application of the invention for processing of natural speech.

FIG. 5 illustrates one application for processing of natural speech. In step 501 natural speech of a known speaker is inputted. This corresponds to inputting of a sound wave 401 as depicted in FIG. 4. The natural speech is windowed by the raised cosine 402 (cf. FIG. 4) or by another suitable window function which is centered with respect to the zero phase $\phi_0+\Delta\phi$.

This way the natural speech is decomposed into pitch bells (cf. pitch bell 403 of FIG. 4) which are provided in step 503.

In step 504 the pitch bells provided in step 503 are utilized as "building blocks" for speech synthesis. One way of processing is to leave the pitch bells as such unchanged but leave out certain pitch bells or to repeat certain pitch bells. For example if every fourth pitch bell is left out this increases the speed of the speech by 25% without otherwise altering the sound of the speech. Likewise the speech speed can be decreased by repeating certain pitch bells.

Alternatively or in addition the distance of the pitch bells is modified in order to increase or decrease the pitch.

In step 505 the processed pitch bells are overlapped in order to produce a synthetic speech waveform which sounds quasi natural.

Figure 6:
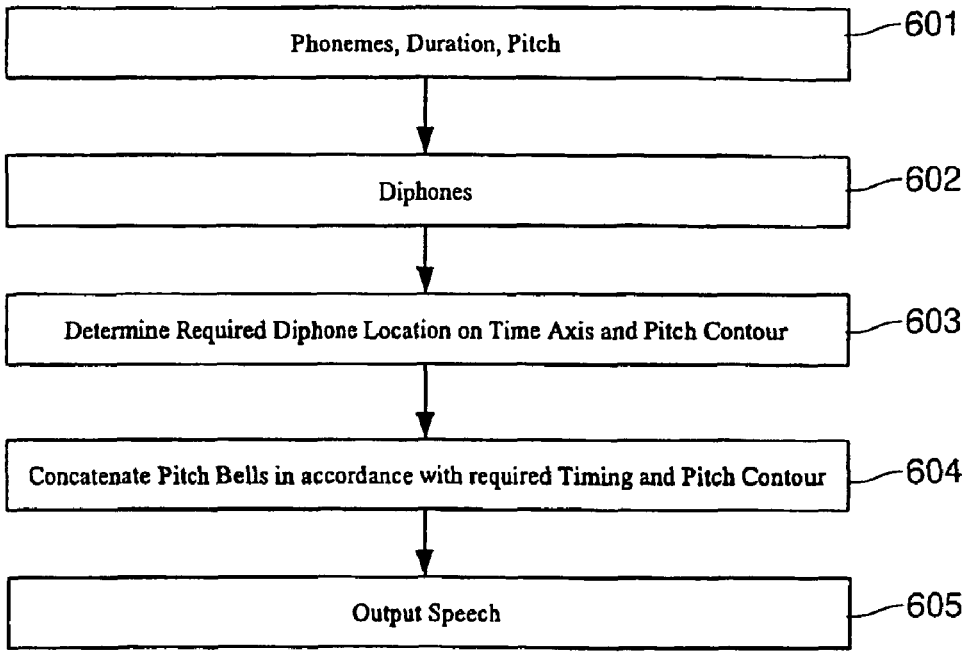
FIG. 6 is illustrative of an application of the invention for text-to-speech.

FIG. 6 is illustrative of another application of the present invention. In step 601 speech information is provided. The speech information comprises phonemes, duration of the phonemes and pitch information. Such speech information can be generated from text by a state of the art text-to-speech processing system.

From this speech information provided in step 601 the diphones are extracted in step 602. In step 603 the required diphone locations on the time axis and the pitch contour is determined based on the information provided in step 601.

In step 604 pitch bells are selected in accordance with the timing and pitch requirements as determined in step 603. The selected pitch bells are concatenated to provide a quasi natural speech output in step 605.

Figure 9:
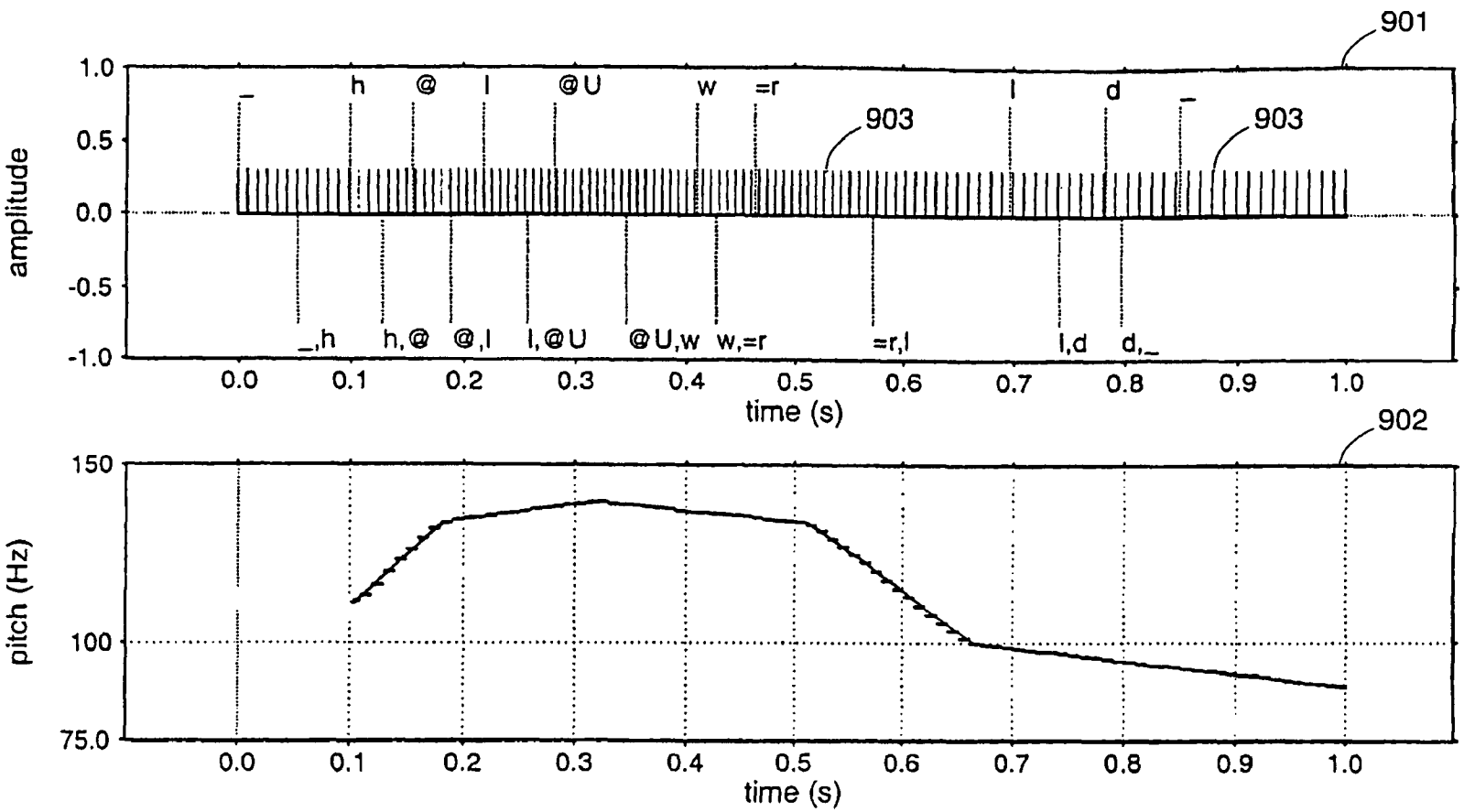
FIG. 9 is illustrative of the result of a processing of the files of FIGS. 7 and 8.

This procedure is further illustrated by means of an example as shown in FIGS. 7 to 9.

FIG. 7 shows a phonetic transcription of the sentence "HELLO WORLD!". The first column 701 of the transcription contains the phonemes in the SAMPA standard notation. The second column 702 indicates the duration of the individual phonemes in milliseconds. The third column comprises pitch information. A pitch movement is denoted by two numbers: position, as a percentage of the phoneme duration, and the pitch frequency in Hz.

The synthesis starts with the search in a previously generated database of diphones. The diphones are cut from real speech and consist of the transition from one phoneme to the other. All possible phoneme combinations for a certain language have to be stored in this database along with some extra information like the phoneme boundary. If there are multiple databases of different speakers, the choice of a certain speaker can be an extra input to the synthesizer.

FIG. 8 shows the diphones for the sentence "HELLO WORLD!", i.e. all phoneme transitions in the column 701 of FIG. 7.

FIG. 9 shows the result of a calculation of the location of the phoneme boundaries, diphone boundaries and pitch period locations which are to be synthesized. The phoneme boundaries are calculated by adding the phoneme durations. For example the phoneme "h" starts after 100 ms of silence. The phoneme "schwa" starts after 155 ms=100 ms+55 ms, and so on.

The diphone boundaries are retrieved from the database as a percentage of the phoneme duration. Both the location of the individual phonemes as well as the diphone boundaries are indicated in the upper diagram 901 in FIG. 9, where the starting points of the diphones are indicated. The starting points are calculated based on the phoneme duration given by column 702 and the percentage of phoneme duration given in column 703.

The diagram 902 of FIG. 9 shows the pitch contour of "HELLO WORLD!". The pitch contour is determined based on the pitch information contained in the column 703 (cf. FIG. 7). For example, if the current pitch location is at 0.25 seconds than the pitch period would be at 50% of the first '1' phoneme. The corresponding pitch lies between 133 and 139 Hz. It can be calculated with a linear equation:

$$\frac{(0.8\cdot 63+0.5\cdot 64)\cdot 133+(0.2\cdot 128+0.5\cdot 64)\cdot 139}{0.8\cdot 63+64+0.2\cdot 128}=135.5\text{ Hz} \quad (1)$$

The next pitch location would than be at 0.2500+1/135.5=0.2574 seconds. It is also possible to use a non-linear function (like the ERB-rate scale) for this calculation. The ERB (equivalent rectangular bandwidth) is a scale that is derived from psycho-acoustic measurements (Glasberg and Moore, 1990) and gives a better representation by taking into account the masking properties of the human ear. The formula for the frequency to ERB-transformation is:

$$ERB(f)=21.4\cdot\log^{10}(4.37\cdot f) \quad (2)$$

where f is the frequency in kHz. The idea is that the pitch changes in the ERB-rate scale are perceived by the human ear as linear changes.

Note that unvoiced regions are also marked with pitch period locations even though unvoiced parts have no pitch.

The varying pitch is given by the pitch contour in the diagram 902 is also illustrated within the diagram 901 by means of the vertical lines 903 which have varying distances. The greater the distance between two lines 903 the lower the pitch. The phoneme, diphone and pitch information given in the diagrams 901 and 902 is the specification for the speech to be synthesized. Diphone samples, i.e. pitch bells (cf pitch bell 403 of FIG. 4) are taken from a diphone database. For each of the diphones a number of such pitch bells for that diphone is concatenated with a number of pitch bells corresponding to the duration of the diphone and a distance between the pitch bells corresponding to the required pitch frequency as given by the pitch contour in the diagram of 902.

The result of the concatenation of all pitch bells is a quasi natural synthesized speech. This is because phase related discontinuities at diphone boundaries are prevented by means of the present invention. This compares to the prior art where such discontinuities are unavoidable due to phase mismatches of the pitch periods.

Also the prosody (pitch/duration) is correct, as the duration of both sides of each diphone has been correctly adjusted. Also the pitch matches the desired pitch contour function.

Figure 10:
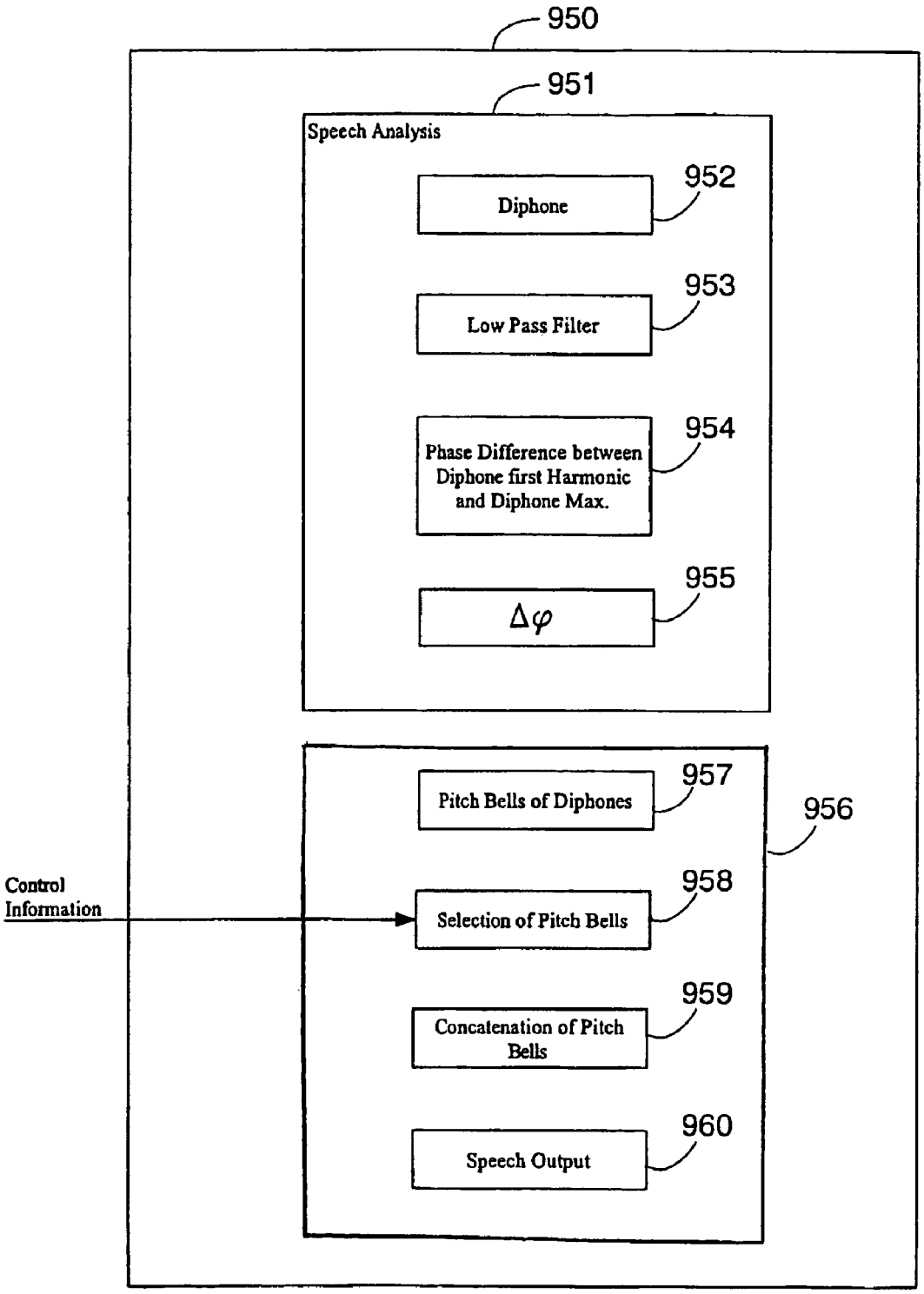
FIG. 10 shows a block diagram of a speech analysis and synthesis apparatus in accordance with the present invention.

FIG. 10 shows an apparatus 950, such as a personal computer, which has been programmed to implement the present invention. The apparatus 950 has a speech analysis module 951 which serves to determine the characteristic phase difference Δϕ. For this purpose the speech analysis module 951 has a storage 952 in order to store one diphone speech wave. In order to obtain the constant phase difference Δϕ only one diphone is sufficient.

Further the speech analysis module 951 has a low-pass filter module 953. The low-pass filter module 953 has a cut-off frequency of about 150 Hz, or another suitable cut-off frequency, in order to filter out the first harmonic of the diphone stored in the storage 952.

The module 954 of the apparatus 950 serves to determine the distance between a maximum energy location within a certain period of the diphone and its first harmonic zero phase location (this distance is transformed into the phase difference Δϕ). This can be done by determining the phase difference between zero phase as given by the positive zero crossing of the first harmonic and the maximum of the diphone within that period of the harmonic as it has been illustrated in the example of FIG. 2.

As a result of the speech analysis the speech analysis module 951 provides the characteristic phase difference Δϕ and thus for all the diphones in the database the period locations (on which e.g. the raised cosine windows are centered to get the pitch-bells). The phase difference Δϕ is stored in storage 955.

The apparatus 950 further has a speech synthesis module 956. The speech synthesis module 956 has storage 957 for storing of pitch bells, i.e. diphone samples which have been windowed by means of the window function as it is also illustrated in FIG. 2. It is to be noted that the storage 957 does not necessarily have to be pitch-bells. The whole diphones can be stored with period location information, or the diphones can be monotonized to a constant pitch. This way it is possible to retrieve pitch-bells from the database by using a window function in the synthesis module.

The module 958 serves to select pitch bells and to adapt the pitch bells to the required pitch. This is done based on control information provided to the module 958.

The module 959 serves to concatenate the pitch bells selected in the module 958 to provide a speech output by means of module 960.

List of Reference Numerals sound wave 201
first harmonic 202
maximum 203
maximum 204
sound wave 401
raised cosine 402
pitch bell 403
sound wave 404
column 701
column 702
column 703
diagram 901
diagram 902
apparatus 950
speech analysis module 951
storage 952
low pass filter module 953
module 954
storage 955
speech synthesis module 956
storage 957
module 958
module 959
module 960

The invention claimed is:

1. A method, operable in a computer system, for analyzing of speech, the method causing the computer system to execute the acts of:

inputting a speech signal;

obtaining a first harmonic of the speech signal, determining a phase-difference (Δϕ) between the speech signal and the first harmonic for centering a windowing function, wherein said phase difference is determined between a phase of a maximum amplitude of said speech signal and a phase zero of the first harmonic, wherein a zero-crossing of the first harmonic defines the phase zero of the first harmonic; and outputting the phase difference to a memory for storage.

2. The method of claim 1, wherein the determining comprises the act of determining a location of said maximum of the speech signal.

3. The method of claim 1, whereby the speech signal is a diphone signal.

4. A computer readable medium storing a computer program product which when loaded into a computer system caused the computer system to perform a method in accordance with claim 1.

5. The method of claim 1, wherein the zero-crossing is a positive zero-crossing.

6. The method of claim 1, further comprising the act of extracting diphones from the speech signal, wherein the obtaining act includes low-pass filtering of the diphones.

7. A method for synthesizing speech, the method, operable in a computer system, comprising the acts of:

windowing by a window function diphone samples obtained from a speech signal;

selecting the windowed diphone samples, wherein the window function is centered with respect to a phase angle which is determined as a phase difference between a phase of a maximum amplitude of said speech signal and a phase zero of a zero crossing of a first harmonic of the speech signal; and concatenating the selected windowed diphone samples to form the synthesized speech; and outputting the synthesized speech.

8. The method of claim 7, the speech signal being a diphone signal.

9. The method of claim 7, the window function being a raised cosine or a triangular window.

10. The method of claim 7 further comprising inputting of information being indicative of diphones and a pitch contour, the information forming the basis for selecting of the windowed diphone samples.

11. The method of claim 7, wherein the information is provided from a language processing module of a text-to-speech system.

12. The method of claim 7 further comprising the acts of:

inputting of speech, and windowing the speech by the window function to obtain the windowed diphone samples.

13. The method of claim 7, wherein the window function is centered on the phase angle which is equal to the phase difference plus the phase zero.

14. The method of claim 7, wherein the window function is be symmetric with respect to the phase angle.

15. The method of claim 7, wherein the window function and the diphone samples that are windowed are offset by the phase difference.

16. A speech analysis device for analyzing a speech signal comprising:

a filter for obtaining a first harmonic of the speech signal, a processor for determining a phase difference ($\Delta\phi$) between the speech signal and the first harmonic for centering a windowing function, wherein said phase difference is determined between a phase of a maximum amplitude of said speech signal and a phase zero ($\phi_0$) of the first harmonic, wherein a zero-crossing of the first harmonic defines the phase zero.

17. The speech analysis device of claim 16, wherein the speech signal is a diphone signal.

18. A speech synthesis device comprising a processor configured for:

selecting of windowed diphone samples of a speech signal, the diphone samples being windowed by a window function being centered with respect to a phase angle which is determined as a phase difference between the speech signal and a first harmonic of the speech signal, wherein said phase difference is determined between a phase of a maximum amplitude of said speech signal and a phase zero of the first harmonic of the speech, wherein a zero-crossing of the first harmonic defines the phase zero; and concatenating the selected windowed diphone signals.

19. The speech synthesis device of claim 18, wherein the speech signal is a diphone signal.

20. The speech synthesis device of claim 18 the window function being a raised cosine or a triangular window.

21. The speech synthesis device of claim 18, wherein the processor is further configured to receive information indicative of diphones and a pitch contour, and to select the windowed diphones based on the information.

22. A text-to-speech system comprising:

a language processor for providing information being indicative of diphones and a pitch contour of a speech signal; and a speech synthesizer configured to:

select windowed diphone samples based on the information, the diphone samples being windowed by a window function being centered with respect to a phase angle which is determined as a phase difference between a phase of a maximum amplitude of said speech signal and a first harmonic of the speech signal, wherein a zero-crossing of the first harmonic defines the phase zero; and concatenate the selected windowed diphone samples.

23. The text-to-speech system of claim 22, whereby the window function is a raised cosine or a triangular window.

24. A speech processing system comprising a processor configured to:

receive a signal comprising natural speech signal, window the natural speech signal by a window function being centered with respect to a phase angle determined as a phase difference between a phase of a maximum amplitude of said natural speech signal and a phase zero of the first harmonic of the natural speech signal to provide windowed diphone samples, wherein a zero-crossing of the first harmonic defines the phase zero, process the windowed diphone samples, and concatenate the selected windowed diphone samples.

* * * * *